US005458312A

United States Patent [19]

Goldberg

[11] Patent Number: 5,458,312

[45] Date of Patent: Oct. 17, 1995

[54] INVERTED BOOK HOLDER

[76] Inventor: Herbert E. Goldberg, 195 Heath's Bridge Rd., Concord, Mass. 01742

[21] Appl. No.: 147,940

[22] Filed: Nov. 8, 1993

Related U.S. Application Data

[63] Continuation-in-part of Ser. No. 855,197, Nov. 23, 1992, Pat. No. 5,259,581.

[51] Int. Cl.[6] ..... A47B 5/04

[52] U.S. Cl. ..... 248/444.1; 248/445; 248/454

[58] Field of Search ..... 248/444.1, 444, 248/445, 447, 447.2, 448, 451, 452, 453, 454, 457, 460

[56] References Cited

U.S. PATENT DOCUMENTS

| | | | |
|---|---|---|---|
| 872,905 | 12/1907 | Connors | 248/441.1 X |
| 922,610 | 5/1909 | Mills | 248/444.1 |
| 2,638,701 | 5/1953 | Dahlgren | 248/444.1 X |
| 2,908,465 | 10/1959 | Lykes | 248/460 X |
| 3,350,150 | 10/1967 | Schwarm | 248/454 X |
| 4,465,255 | 8/1984 | Hill | 248/441.1 X |
| 4,754,945 | 7/1988 | Diamond | 248/460 |
| 4,867,407 | 9/1989 | Becker | 248/444.1 |
| 5,129,616 | 7/1992 | Carson | 248/444.1 X |

FOREIGN PATENT DOCUMENTS

| | | | |
|---|---|---|---|
| 191568 | 10/1956 | Austria | 248/454 |
| 1518012 | 2/1968 | France | 248/441.1 |
| 920537 | 11/1954 | Germany | 248/454 |
| 391993 | 5/1965 | Switzerland | 248/455 |
| 1525080 | 9/1978 | United Kingdom | 248/454 |

*Primary Examiner*—J. Franklin Foss

[57] ABSTRACT

A book holding structure is provided having means to position a book in two positions, one for turning the pages of the book the other for reading from a supine position, means to flatten and to illuminate it and to convert it into a conventional easel.

21 Claims, 4 Drawing Sheets

Figure 3A:
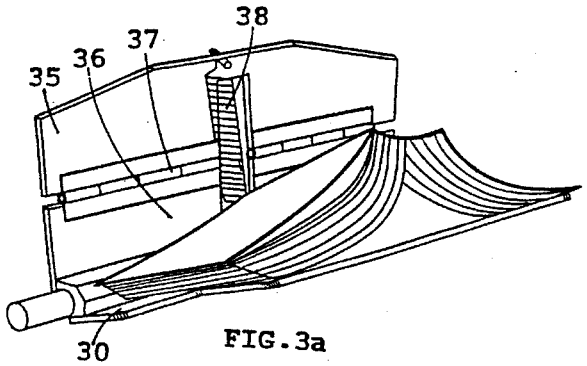

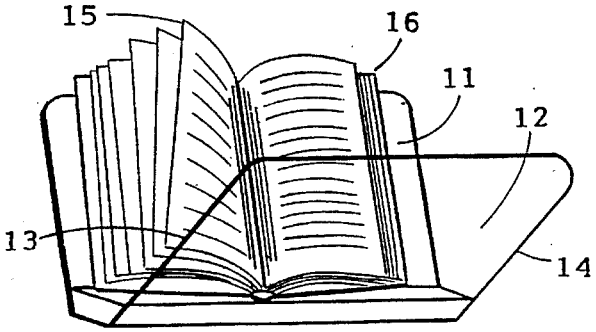
FIG.1a
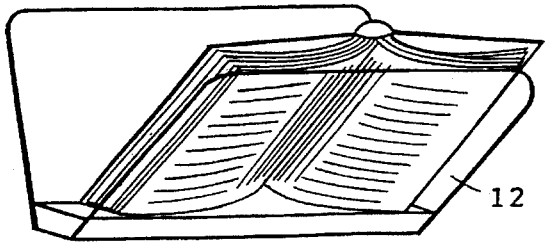
FIG.1b
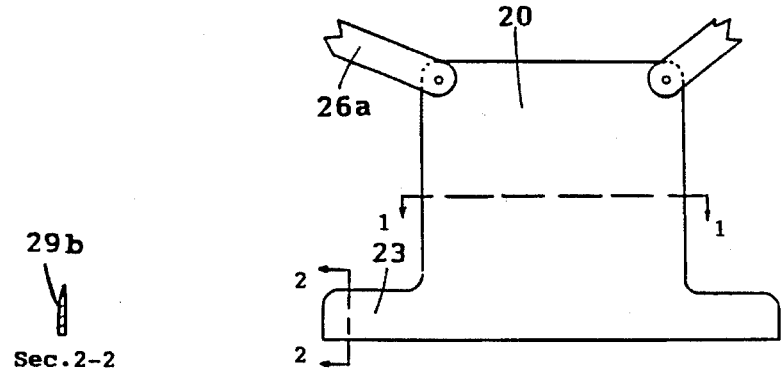
Fig.2a
Fig.2c
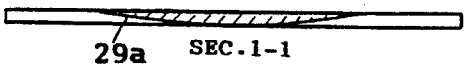
Fig 2b
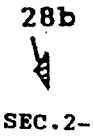
Fig.2f
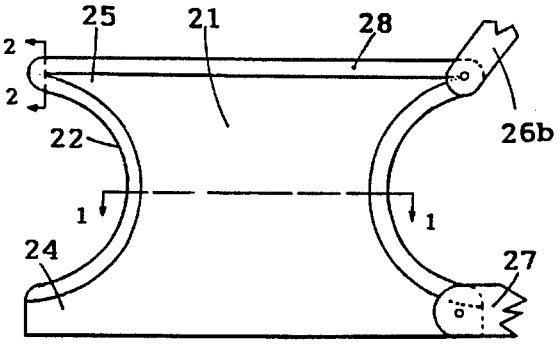
Fig.2d
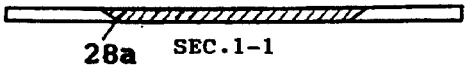
Fig.2e

INVERTED BOOK HOLDER

Be it known that Herbert E. Goldberg, a citizen of the United States, residing at 195 Heath's Bridge Road, Concord, Mass., 01742, has invented a new and useful improvement in Book Holding Devices of which the following is a specification, reference being had to the accompanying drawings. This application is a continuation-in-part of application Ser. No. 07/855,197, filed on Nov. 23, 1992, now U.S. Pat. No. 5,259,581.

SUMMARY OF THE INVENTION

This invention is directed to an improved inverted book holder, which permits pages to be turned safely by a person in a reclining or supine position, does not require any readjustments as the size or nature of the reading material is changed, allows easy setting of the reading distance, provides reflection free illumination, and also serves as a conventional bedside easel and table.

BACKGROUND OF THE INVENTION

This invention is concerned with improvements of the devices used to position books and other reading matter for persons who find it difficult to hold such matter securely in their hands, especially while reclining or while resting in a supine position. Some are in this situation because of arthritis, others must lie on their backs while recovering from surgery or injuries, still others just find it fortable to hold reading matter, especially tightly bound "paperbacks", while resting on a sofa or in bed.

For over sixty years much effort has gone into the design of supports to hold reading matter in an inverted position, using retaining clamps and springs, as well as transparent easels. However, only a very few of these devices have addressed the problem of turning pages, which is the most serious obstacle to reading from a supine position.

THE PRIOR ART

The designs disclosed in the prior art are mechanically complex, requiring the sliding about of spacing members, retaining rods or springs by the user, and the loosening and tightening of wing nuts or the moving of leaf springs whenever reading material is inserted, particularly if there is a change of size or thickness. They were not designed to hold magazines, newspapers, or small items such as letters or photographs, and do not provide for easy adjustment of the reading distance, a crucial need for those above age 45 or 50, who depend on bifocal glasses to compensate for their reduced range of visual accommodation.

Most importantly, many of the prior devices do not protect the user adequately from injury by books falling from the book holder when pages are being turned.

It thus appears that the prior art has not addressed the needs of persons unfamiliar with things mechanical, and the requirements of the handicapped and elderly.

Ferraro, U.S. Pat. No. 5,058,843

It is believed that the procedure of sliding out a page that is pressed against member 35, feeding it through opening 39, and then inserting it under leaf spring 43, requires a handy person indeed, and that it would be difficult to adjust the height of the member frame 31 from a supine position as the book thickness changes.

Romaniuk, U.S. Pat. No. 2,610,434

The adjustments for book thickness (Col.3, lines 1–15), and book size (Col.2, lines 39–45), seem too difficult to be done from a supine position, as well as unsafe if done while the device is in the reading position (Col.3, line 66).

The mere possibility that reading material may fall onto the user's face as the bookholder structure 10 is turned into the reading position, would render the device unacceptable for general use.

In the tests described below it was found difficult to turn pages by their lower corners as shown in FIG. 2 of the patent, and that a full length cross bar 12 would restrict access to the important upper corners of the book.

Motono, U.S. Pat. No. 1,609,180

The device requires the page holding member 28 to be adjusted (page.l, line 102–112) according to calibration marks to be read by a person, who is in a reclining position, and unable to check manually whether the adjustment is safe enough to keep the book from falling.

Furthermore, the automatic turning mechanism does not take account of the fact that many books, particularly "paperbacks", do not lie flat until well worn As books are positioned at 20 or 30 degrees from the vertical, pages will not lie as shown in FIG. 3 of the patent but will turn spontaneously, and often stand straight up. The extended pages will be crushed and jammed by the page holding members 28 and 29, whether rods or members, as they approach head on, unless the user can hold the book against the back member 15, keep the two facing pages flat, and turn the book holder to the reading position, all at the same time and from a reclining posture.

OBJECT OF THE INVENTION

It is an object of the invention to provide an improved book reading means, whereby a person of minimal mechanical dexterity may read from a supine or reclining position, turn pages and handle material of many sizes and shapes without having to make mechanical adjustments.

It is another object of the invention to provide means to prevent reading matter from falling from the book holder when pages are being turned, and to permit its safe use by persons who at times may fall asleep.

It is still another object of the invention to provide simple means allowing the user to adjust the viewing distance of the material to be read and the viewing angle at which it is presented.

THE INVENTION

In the following description as well as in the claims the term "book" or "books" will represent all reading matter, including magazines, letters, newspapers, photographs, and any other matter being examined visually.

The invention addresses the above mentioned problems of holding books by:

(1) providing a safety transparent membere of suitable contour such as a plate or a filamentary array or a screen, which is sufficiently transparent for books to be read through it to form a safety member, such as a plate or a net, on which a book may be placed face down, and applying sufficient constraints to the back of the book to flatten it if necessary, and to prevent pages from curling up or turning spontaneously.

In order to distinguish this disclosure from the above mentioned pending patent application 07/955197, the term "Transparent Safety Net" will be used in the following description and claims to represent all transparent safety surfaces other than plates, and the term "Transparent Safety Member" will represent all transparent safety surfaces.

(2) providing a second surface or a frame, positioned in back of the above mentioned safety surface to support the back of the book while pages are being turned.

(3) providing means of moving the book between the two surfaces referred to above.

(4) providing safety means to prevent injury to the user by preventing an accidental release of the book from the holder.

(5) providing means for stabilizing the holder both the viewing and the page turning positions.

(6) providing means to prevent pages from turning on their own when the book is in the page turning position.

(7) providing a parallel pivot mount to adjust the reading distance and the viewing angle as suited to the user.

(8) providing means for illumination to strike the book at a constant predetermined angle regardless of the bookholder's position.

(9) providing means convert the book holder to a conventional easel or bedside table.

SPECIFICATION DESCRIPTION OF THE DRAWINGS

FIGS. 1*a* and 1*b* are perspective views of a test model, built to explore the practicality of the invention.

FIGS. 2*a,b,c* and 2*d,e,f* are front and cross-sectional views of two front members used in certain embodiments of the invention.

Figure 3C:
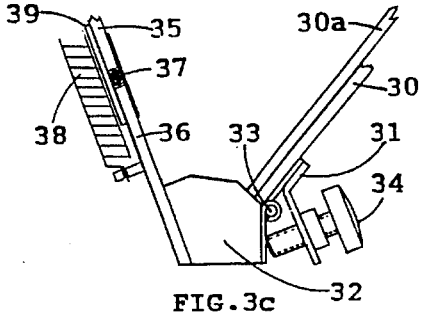
Figure 3B:
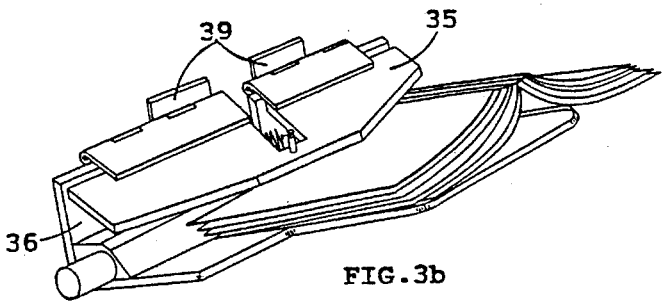

FIGS. 3*a,b,c* are perspective and side views of one way of carrying out the invention.

Figure 4A:
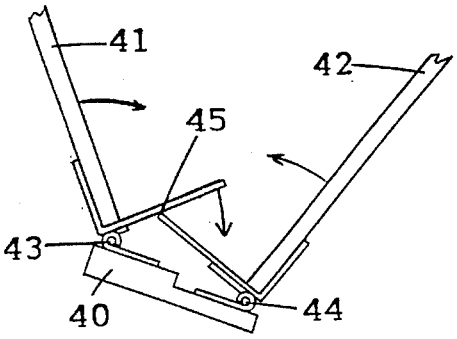

FIGS. 4*a,b,c,d* are perspective and side views of another way of carrying out invention, and illustration a system of illumination.

Figure 5A:
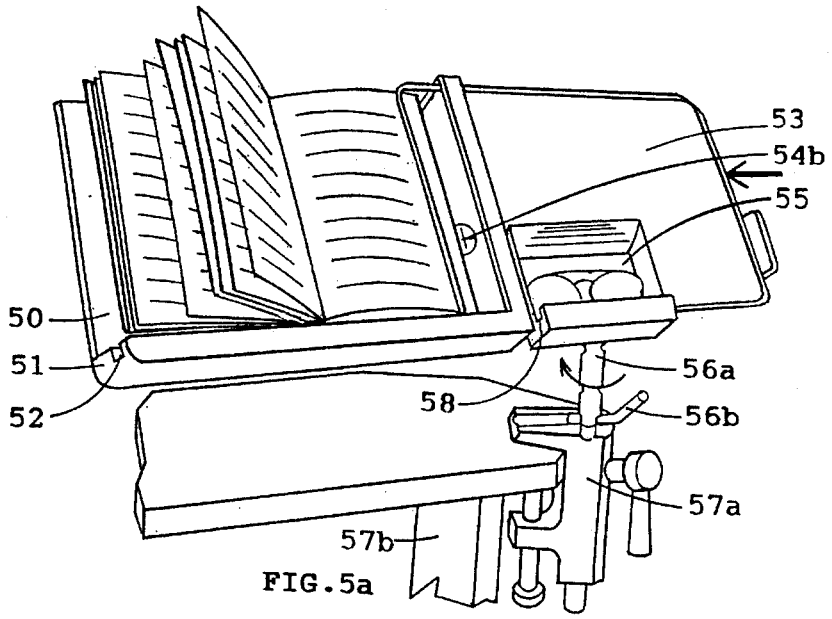
Figure 5B:
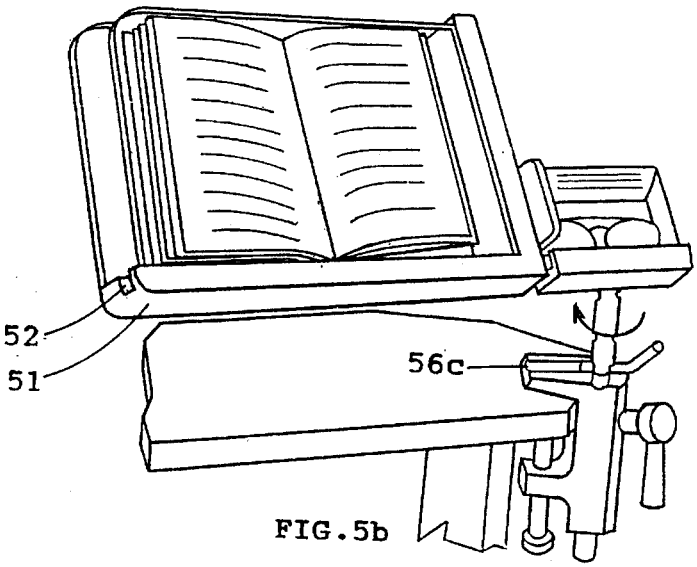

FIGS. 5*a,b,c,d* and 6*a,b* respectively, are views of still other ways of carrying out the invention.

Figure 7:
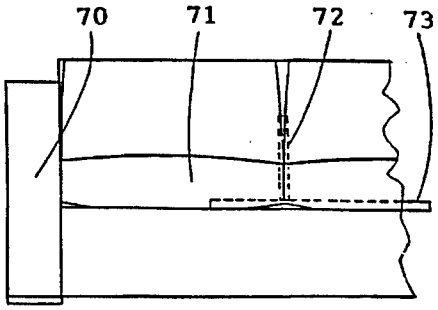

FIG. 7 is a front view of a mounting device used to practice the invention in the home.

Figure 8A:
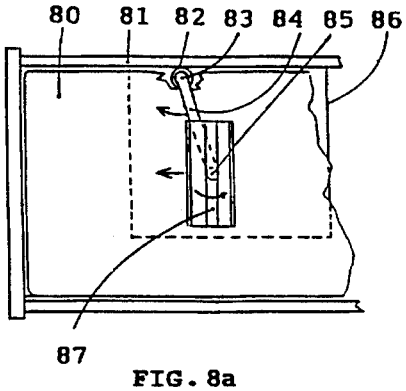
Figure 8B:
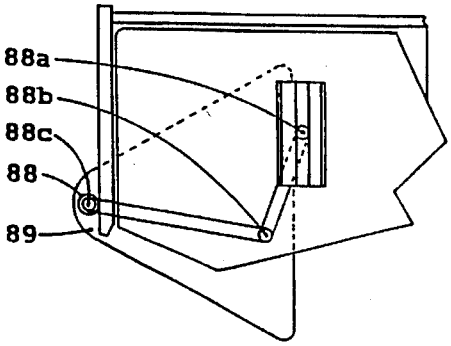

FIGS. 8*a* and 8*b* are two views of an arrangement for moving the book holder closer to or further away from the user, and also of orienting it to fit his or her needs.

Figure 9A:
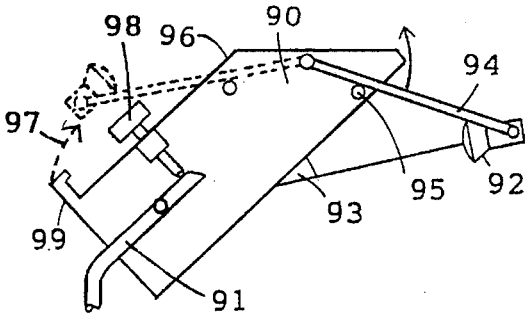
Figure 9B:
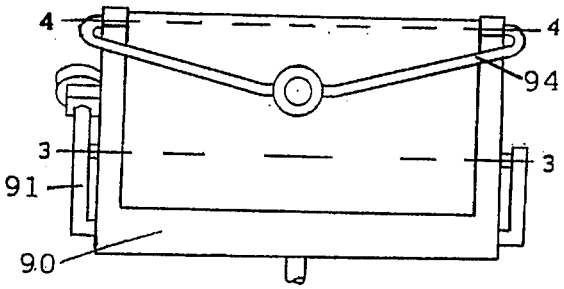

FIGS. 9*a* and 9*b* are views of an alternate way of supporting the device.

DESCRIPTION OF THE INVENTION

FIGS. 1*a* and 1*b* illustrate a test device, built to explore the practicality of the invention described above. The member 11 faces backward and supports the book when the user wishes to turn pages (FIG. 1*a*). Whenever the user wishes to read or view the book from a supine or a reclining position, he moves it forward against the transparent safety surface, member 12, FIG. 1*b*, which thus is positioned at all times between the book and the person viewing it.

The book shown in FIGS. 1*a,b* is of the hard cover type and somewhat worn. It thus lies flatter on members 11 and 12 than the "paperbacks" shown in FIGS. 3, 5 and 6 described below.

The following observations were made in practical trials of the device of FIGS. 1*a* and *b*.

1. Reading position (FIG. 1*b*)

Viewing and reading were excellent. The best forward tilt of member 12 was 20 to 30 degrees from the vertical, but tilts as low as 5 degrees and as high as 60 degrees were found useful for readers suffering from certain disabilities, such as being unable to lower the head while seated, or having to lie on a flat surface with only minimal head support.

2. Page turning position (FIG. 1*a*)

When the book was placed in the page turning position, the sides 13 and 14 of front member 12 interfered severely with access to the upper corners 15 and 16 of the book, which are the best areas to grasp the pages to be turned. The width ofthe front member 12 should thus be reduced to less than ten inches, either all the way up as shown on member 20, FIG. 2*a*, or by narrowing the width of the member for a portion of its height on one side, or on both sides as outlined by contour 22, FIG. 2*d*. It was found that a front member width of five to seven inches at the narrowest point provides excellent access to the upper page corners, where the hand motion required for page turning is most natural. This still covers the width of the printed page area of an average book. The book can be moved horizontally to read adjacent pages if this is considered desirable.

Wings 23, 24 and 25 may extend along the top and bottom edges of members 20 and 21 to keep the corners of the book from curling down when it is in the reading position. They do not interfere with the turning of pages in any way. Swiveling extensions 26*a,b* and 27 similar to those commonly used on music stands, can be added at the upper corners of either member or to its lower wings to support the extreme corners of newspapers or other large reading matter.

The optical discontinuity of reading across the edges of members 20 and 21, although not serious, can be eliminated almost completely by molding some of their areas into very weak plano-convex lens shapes 29*a,b*, FIGS. 2*b,c*, or by beveling their edges 28*a,b*, FIGS. 2*e,f*, or by using a combination of the two methods.

Access to the important top corners of the book can be improved significantly if the back tilt of back member 11, FIG. 1*a*, is held to the minimum required for stability, about 10 to 30 degrees from the vertical. However, the included angle between members 11 and 12 should be above 30 degrees to allow sufficient clearance for the turning of pages. An angular separation of 50 degrees between members 11 and 12, combined with a spacing of one to two inches at the bottom of the cavity formed by them, proved very satisfactory.

FIGS. 3*a,b,c* show an embodiment of the invention designed in response to the trial results described above. The transparent front safety member 30, FIG. 3*a*, is similar in contour to member 20, FIG. 2*a*. It is attached to a bent metal member 31, FIG. 3*c*, and connected to the base 32 of the device by a horizontal hinge 33, FIG. 3*c*, positioned behind the bend of member 31. An adjustment screw 34 is threaded into member 31 at a point located below the hinge axis. It bears against the base 32 of the device and serves to adjust the angle of tilt of the front safety member 30, depending on the needs of the user.

The back support member 35/36 of the device has been divided horizontally into two portions, with the upper portion 35, FIG. 3*a*, acting as a book flattener. The lower portion 36 is fixed to the base 32, FIG. 3*c*, of the device, tilted back at approximately 20 degrees to the vertical. The two portions 35 and 36 are connected by a horizontal hinge 37, FIGS. 3*a* and *d*. A toggle spring 38 is placed between the two portions of the back member, so as to urge the upper portion either backward (FIG. 3*a*) against the stops 39, which are attached to the lower back portion 36, FIG. 3*c*, or forward against the back of a book resting on the front safety member 30, FIG. 3*b*. The book flattening action of this toggle spring, coupled with the wedging action taking place between member 35 and the back of a paperback book is seen by comparing FIGS. 3*a* and 3*b*.

It should be noted that the device shown in FIGS. 3*a,b* above, although being open on top and on both sides, protects the user from falling books. It may be used to view large items such as newspapers and picture magazines by placing a sufficiently large, stiff, and transparent plastic sheet 30*a*, FIG. 3*c*, between such large items to be viewed and the front safety member 30 of the device.

Figure 4B:
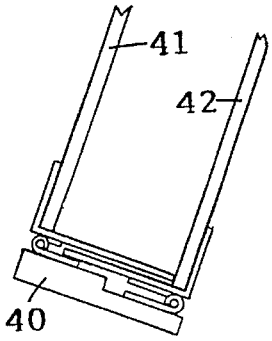

FIGS. 4*a* and 4*b* show a clamshell device, which automatically flattens the book as it is brought into the viewing position. Plates 41 and 42 are mounted to rotate about hinges 43 and 44, FIG. 4*b*, which are attached to the base member 40. As back support member 41 is brought up from the page-turning position to the reading position, it rises from an approximate 20 degree back tilt (page-turning) to an approximate 20 degree forward tilt (reading), and a cam action is generated along the line of contact 45, FIG. 4*a*, which causes the safety front member 42 to rise from an approximately 40 degree forward (page turning) tilt to an approximately 20 degree forward (reading) tilt. Thus, both members 41 and 42 rotate and become parallel as they move into their reading positions, thereby onstraining and flattening tightly bound books, especially paperbacks. This action occurs regardless of the size of the book, which remains separated from the viewer at all times by the front safety member 42.

Figure 4C:
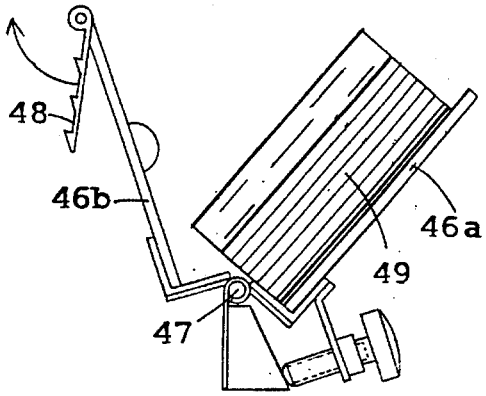
Figure 4D:
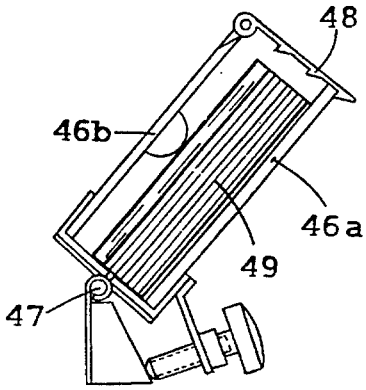

FIGS. 4*c* and 4*d* are side views of another clamshell design shown in the page turning and page viewing positions respectively. The front member 46*a* and the back member 46*b* are hinged to the base 46*c* as before, but the hinge pins of the two members are positioned in line or nearly in line, or combined into a single pin 47. In FIG. 4*d* the members 46*a,b* are shown clamped together by one or several ratchets 48 so as to flatten the book 49 with a transverse boss 46*g* pressing against it's spine. This clamped package of members 46*a* and *b*, ratchet 48, and book 49 may be rotated about the hinge pin or pins 47 to adjust the viewing angle without affecting the book flattening action.

FIGS. 5*a,b,c,d*, show a reader design which employs the same parallel member book flattening system as the clamshell model of FIGS. 4*a* and *b*, but uses a movable casing 51 to hold the book. FIG. 5*a* shows the device in the page turning position, facing up. The casing 51 is supported by a shaft 54*b*, FIGS. 5*a* and 5*d*, which extends into a horizontal bearing tube 54*c*. This tube is attached to a suppporting structure 55, which can be used as an eyeglass holder. It is supported by the vertical post 56*a* and the table clamp 57*a*, FIG. 5*a*.

The transparent front safety member 53, in this case a plate, is supported by, and slides along, a groove 52 positioned along the bottom edge of casing 51, FIGS.5 *a,b*. In the open position shown in FIG. 5*a*, this front safety member is also supported by a groove 58, FIGS. 5*a,c,d*, positioned along the bottom edge of the eyeglass holder 55, The presence of the front safety member 53 in both groves 52 and 58 generates a strong keying and locking action, which prevents the casing 51 from turning in the bearing tube 54*c* as long as the book is even slightly uncovered.

Alternatively, if the eyeglass case were omitted, an effective locking action could be obtained by using the restraining member 58*a*, FIG.5, shown there in dotted outline.

Figure 5C:
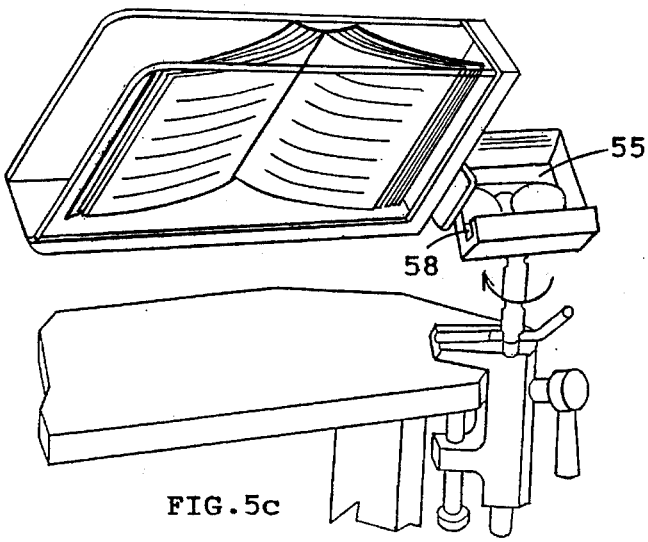
Figure 5D:
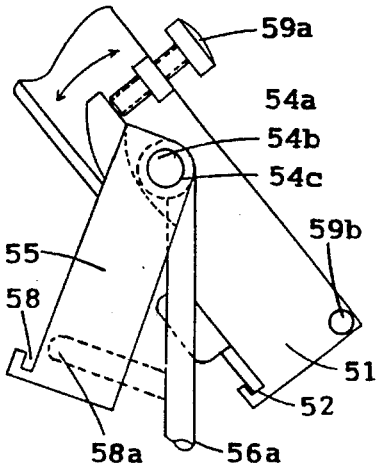

After a book has been placed against the back member 50 of casing 51, and after pages have been turned to the desired place, the front safety member is moved along groove 52 to cover the book. Being no longer restrained by groove 58, the closed casing may now be turned into the reading position defined by an adjustable stop 59*a*. The interference created by the misalignment of grooves 52 and 58 and the presence of the eyeglass holder 55 as shown in FIG. 5*c*, prevents the front safety member 53 from moving until the casing has been returned to the page-turning position of FIGS. 5*a* and *b*, as defined by stop 59*b*, FIG. 5*d*.

Returning to FIG. 5*a* it is seen that the left edge of the transparent member 53 is prevented by a stop 53*a* from being fully withdrawn from the casing's opening. The right edge of the book will thus remain under the transparent member to prevent a loss of page position when the casing is opened.

Figure 6A:
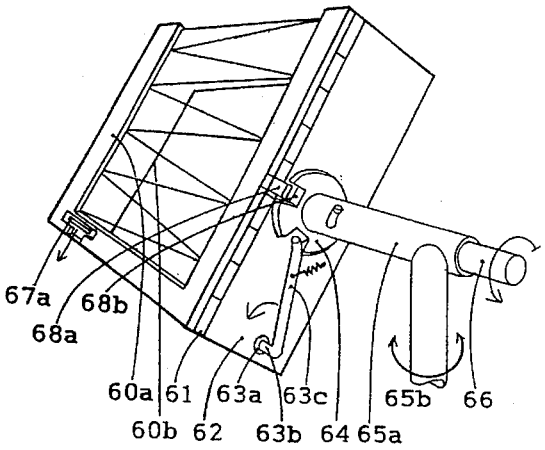
Figure 6B:
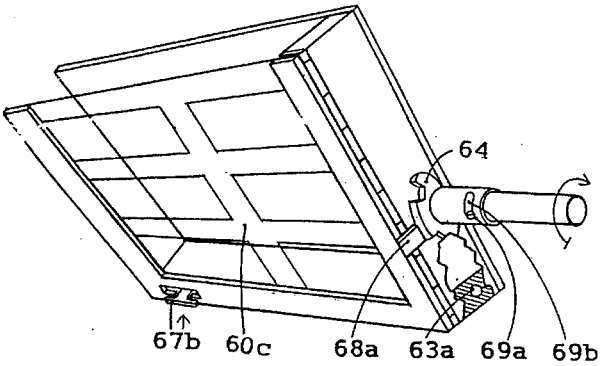

FIG. 6*a* shows a way of reducing the reflections of light discussed below. The transparent front safety surface 60 is not a solid member in this design, but is formed by a frame 60*a* supporting an array 60*b* of tightly stretched wires or transparent filaments, which are dimensioned and spaced to provide the rigidity and transparency required for safety net use. Also transparent grids or screens 60*c* as illustrated in FIG. 6*b* could be substituted for the filaments. FIGS. 6*a* and *b* also show a different way of connecting the front safety member 60*a,b* to the casing 62 by attaching it with a hinge 61. The casing 62 is supported by a shaft 66 which is held in a stationary bearing tube 65*a*. It may be turned as indicated by the arrow A, FIG. 6*a*, to bring the book into the reading position. In FIG. 6*a* the casing is shown in the loading/page-turning position with the safety member still closing it. After the casing has been opened, a book may be placed against the back support. As the casing is opened a detent 68*a* engages the slot 68*b*, FIG. 6*a*, thereby preventing the casing from being turned as long as it is open.

After pages have been turned to the desired place the safety member 60*a,b* or 60*c* is closed, thereby disengaging the detent 68*a* from slot 68*b*, and allowing the casing to be turned into the book viewing position shown in FIG. 6*b*.

As the casing is turned, the detent 68*a* rides on the circular portion of cam 64, which is attached to the stationary bearing tube 65*a*, thereby preventing the safety member 60*a* or *b* from being opened. Additionally, the cam 64 forces the cam follower 63*c* to lock it to the casing 62 at its lower left corner. The cam follower 63*c* acts through a shaft 63*b*, which runs through a hole or slot 63*a*, placed along the bottom of casing 62.

FIGS. 6*a* and 6*b* show the lock in the open and closed positions 67*a* and 67*b* respectively. A stop 69*a* and a slot 69*b* define the angles of tilt of the page-turning and lowest reading positions.

The interlocks between the motion of the front safety members and the rotation of the casings as shown in FIGS. 5 and 6 are important. They assure a safe operation of the devices. because:

(1) The casings cannot be turned away from their page-turning positions unless the front safety members cover the books, and (2) The books cannot be uncovered unless the casings are in their page-turning positions.

The configurations of the reading device shown in FIGS. 5 and. 6 are appropriate as well for users who do not have complete manual control, or who may be confused at times, or cannot be depended upon to operate a reader of this nature reliably. For such applications it may be well to design the casings 52 and 62, FIGS. 5 and 6, with both sides and the top closed, and in some instances to make provision for locking the front safety members in the book-covering positions. In the latter case books would be loaded and pages would be turned by visitors or hospital personnel. Since the casings could be large enough to hold two full pages of most books and magazines, this will give pleasure and relaxation even to people who must depend on others to turn pages for them.

The casings 51 and 62 FIGS. 5 and 6 are supported by cantilever bearing tubes shown in FIGS. 5 and 6. However, if these casings were designed with both sides closed as suggested above and illustrated in FIGS. 9*a,b,* the casing suspension would became more rigid and easier to fabricate. The Figure shows how the casing 90 can be held by a yoke 91, to turn about a horizontal axis 3—3. The yoke 91 is supported by a pivot post.

The designs of FIGS. 5, 6 and 9 involve rotation of a heavy mechanical assembly about a horizontal axis, and thus call for consideration of weight distribution and balance. The location of the shafts 54*b* and 66 and of the yoke 91, FIGS. 5*a,* 5*d,* 6*a* and 9 respectively, with respect to the loaded and unloaded casing is thus important. Since the casing must be stable in the page-turning as well as in the page-viewing positions for all types of books, the axis of rotation should remain sufficiently below the center of gravity of the casing at all times. If this is undesirable, other means such as detents and springs should be used to prevent spontaneous or undesired motion.

Support Devices

The reading devices described above are designed to be placed above and in front of a user who is lying supine, reclining, or sitting in an erect or semi-erect position. They are supported by arms, which extend from the reading device to vertical posts, often positioned to the side and/or in back of the user.

For hospital use the reading devices will usually be attached to the standard hospital bedside tables, using clamp 57*a,* FIG. 5*a,* similar in design to the clamps commonly used to hold commercial desk lamps. They will hold the post 56*a* and similar vertical supports securely. The top of the bedside table may be cleared for other uses by turning the reading device out of the way as indicated by the arrows shown in FIGS. 5*a,b* or by lifting it off the clamp 57*a* all together. Detents 56*c* serve to stabilize the device in the most frequently used positions. The clamp should be attached to the bedside table at a point near the table post 57*b*, where it will not interfere with the normal hospital routine.

For use in the home, the vertical posts of the various reading devices described above would be inserted into suitable floor stands or into companion holding devices, shown in FIG. 7, where a vertical tube 72 is fastened to platform 73 or other substantially horizontal structure. The platform is placed under the matrass of a bed or the seat pillow of a sofa.

For sofa use the bottom side of the platform 73, FIG. 7, must remain flush. The tube 72 will thus project upwards, usually by eight or ten inches. It can be shielded from view by existing or added back pillows.

For use on a bed (FIGS. 8*a,b*) it is deirable to keep the top of the vertical tube 72 of FIG. 7, shown here as 84, below the surface of the mattress 81, extending upward from the platform by three or four inches. It can, however, protrude below the platform as far as needed for stability. FIG. 8*a* illustrates also how a user would adjust the position of the reading device to match his or her individual reading distance accurately, a very important need for those above age fifty or so, who have little eye accommodation left.

The reading device of FIG. 3, shown as 87 in FIG. 8*a,* for example, is connected to the horizontal arm 84 by a pivot joint 85, which cooperates with a second and parallel pivot joint 83, formed by the vertical tubular post inserted into the vertical tube 72 of the companion holding device of FIG. 7, which is shown in FIG. 8*a* as 82.

This "double pivot" suspension system allows the user to move the reading device back and forth without altering its orientation with respect to his or her line of sight, as is illustrated in FIG. 8*a* by the three arrows. The double pivot suspension system also permits the user to draw the device very close and to turn it about pivot 85 if he or she finds this position more comortable for the changing of books.

If a sideways movement is desired, for instance for installations on a double bed, the triple pivot suspension shown in FIG. 8*b* is very useful. It is composed of reader pivot 88*a,* intermediate pivot 88*b,* floor post pivot 88*c*, floor post 88 and floor platform 89. The three pivots are substantially parallel, but do not have to be co-planar The post 88 is shown at the center of the head board, where the reach is short. Although the floor stand 89 is very practical for this type of suspension, a mattress platform could also be used.

The pin 53*b* of FIG. 5*c* or a clamp is used to set the height of the device, and an internal coil or Neg'tor® spring may be positioned within the vertical tube 72, FIG. 7 to take part of the weight of the device when a height adjustment is made.

Illumination

Since inverted bookholders must face down, they do not receive direct light from windows or wall and ceiling fixtures, and require individual illumination. Bedside reading lamps may be used if they are positioned above or to the side of the bookholder in order to prevent reflections of the light source by the front safety member and some glossy magazines from appearing in the field of view. However, these lamps must be re-positioned whenever the tilt angle of the bookholder is changed. A more effective illuminator is shown in FIGS. 4*d* and 9*a* and *b,* where a fluorescent tube or small reflector bulbs 46*a* and 92 have been fastened to the book holder. The central light rays of the illuminating beam should meet the transparent front members at constant angles 46*d* and 93 respectively, regardless of the tilt angle of the book holder.These angles should be within the 15 to 45 degree range, because smaller angles decrease the fraction of light that enters the transparent members by refraction, while larger angles tend to direct the above mentioned reflections into the user's field of view. This restriction can be eased by applying a very weak diffusing coating or a quarter wave anti-reflection coating 46*e* to the transparent member 46*a,* FIG. 4*d*

If the light source is hinged to the book holder of FIGS. 9*a,b,* for instance by a yoke 94, it may be rotated about axis 4—4 into a storage position shown in dotted outline. This would reduces the real and even more so the apparent bulk of the device when it is not in use.

Easel and Table Use

Returning now to FIG. 5*a,* if the book holder were turned 180 degrees about the pivot 85, the viewing person would then face the back support member of the device, in case of FIGS. 9*a,b* the back plate 96. He/she could use it as a conventional easel with adjustable slope, or as a bedside table (dotted arrow 97), by controlling the tilt angle control screw 98. If easel use is contemplated, an easel shelf 99 should be provided.

What I claim as new is:

1. An inverted book reading device for permitting a person in a reclining position to view its contents, comprising a holder for accepting a book or book-like contents, said contents being positionable in either of two positions;

a first, generally backward-tilted position for permitting the turning of pages and a second, generally forward-tilted position to allow visual access to said contents, said holder including a back support means against which said contents rest when they are in said first position, and a front safety member means being transparent and being spaced from said back support means to form-there-between a book receiving cavity, and against which said contents rest when they are in their said second position, said front safety member means supporting said contents of said device at an angle of forward tilt and providing safety means to prevent said contents from falling out of said device when the position of said contents is changed from said first to said second position, and adjustment means to adjust said angle of forward tilt, and said adjustment means being accessible to said person in said reclining position 2. A device according to claim 1, and an illuminator being connected to said book reading device to illuminate said contents with a light flux centered about a direction intersecting said front safety member at an angle between 15 and 45 degrees, said angle being independent of said angle of forward tilt.

3. A device according to claim 2, said illuminator being held in a forward position for book viewing and being hinged to rotate about a horizontal axis to a backward position against stop means operative to position said illuminator for protection and storage.

4. A device according to claim 1, said back support means and said front safety member means being hinged to each other, and means to urge said back support means against said front safety means and thereby forming an assembly operative to flatten said contents, and said assembly being hinged with respect to a base, and adjustment means to adjust said angle of general forward tilt of said assembly with respect to said base, and said adjustment means being accessible to said person in said reclining position.

5. A device according to claim 1, said cavity being a casing and being rotatably supported by a structure to turn about a substantially horizontal axis between said first and second positions, and means to stabilize said first and second positions of said casing, both with and without said contents.

6. A device according to claim 5, said front safety member being slidably held by said casing to provide closed and open positions, and stop means to limit the sliding motion of said front safety member toward said open position, and being operative to allow a portion of said pages to be turned to remain covered, thereby preventing them from turning spontaneously.

7. A device according to claim 1, said adjustment means having an adjustment range sufficiently wide to bring said back support means into positions of low slope, or a horizontal position, and comprising backward facing shelf means being attached to the lower back of said back support means, thereby converting said inverted book reading device into a conventional easel or bedside table.

8. An inverted book reading device for permitting a person in a reclining position to view its contents, comprising a holder for accepting a book or book-like contents, said contents being positionable in either of two positions; a first, generally backward-tilted position for permitting the turning of pages and a second, generally forward-tilted position to allow visual access to said contents, said holder including a back support means against which said contents rest when they are in said first position, and a front safety member means being transparent and being spaced from said back support means to form there-between a book receiving cavity, and against which said contents rest when they are in their said second position, said front safety member means supporting said contents of said device at an angle of forward tilt and providing safety means to prevent said contents from falling out of said device when the position of said contents is changed from said first to said second position, and said front safety member means being safety net means.

9. A device according to claim 8, said front safety net means being less than ten inches wide for at least a portion of its height.

10. A device according to claim 9, said front safety net means being provided with at least one wing-like extension on at least one of its sides.

11. A device according to claim 8, said device comprising a base, and said front safety net means being hinged to said base, and being provided with means for adjusting its angle of tilt.

12. A device according to claim 8, said back support means and said front safety net means being hinged to said base and being movable with respect to each other.

13. A device according to claim 8, said back support means comprising two portions, said two portions being connected by hinge means, and spring means acting to urge one of said portions to a forward position.

14. A device according to claim 8, said front safety net means being movably held by said holder to provide open and closed positions.

15. A device according to claim 14, including interlock means to prevent movement of said front safety net means from said closed to said open position unless said contents are in said first position, and to prevent said positioning of said contents from said first to said second position unless said front safety net means is in said closed position.

16. A device according to claim 14, said front safety net means being slidably held by said holder to provide open and closed positions.

17. A device according to claim 14, said front safety net means being hinged to said holder to provide open and closed positions.

18. A device according to claim 8, said holder being supported by a substantially horizontal bar, said horizontal bar being supported by a structure terminating in clamp means.

19. A device according to claim 8, said holder being supported by a substantially horizontal bar, said horizontal bar being supported by a structure terminating in platform means.

20. A device according to claim 8, being supported by a structure comprising a first pivot joint having a first axis of rotation about a vertical axis, and a second pivot joint having a second axis of rotation, and said first and second axes of rotation being substantially parallel to one another, and being separated by bar means, thereby providing a means for increasing or decreasing the distance between said person and said holder.

21. A device according to claim 20, and comprising a third pivot joint, having a third axis of rotation being substantially parallel to said first and second axes of rotation, and being separated from said first and second pivot joints by bar means, thereby providing means for a sideways motion of said holder.

* * * * *